US008657172B2

(12) United States Patent
Cooper

(10) Patent No.: US 8,657,172 B2
(45) Date of Patent: Feb. 25, 2014

(54) DEVICE FOR DISPENSING PLASTIC FASTENERS

(75) Inventor: William J. Cooper, Natick, MA (US)

(73) Assignee: Avery Dennison Corporation, Pasadena, CA (US)

( * ) Notice: Subject to any disclaimer, the term of this patent is extended or adjusted under 35 U.S.C. 154(b) by 66 days.

(21) Appl. No.: 13/209,986

(22) Filed: Aug. 15, 2011

(65) Prior Publication Data

US 2012/0061416 A1 Mar. 15, 2012

Related U.S. Application Data

(63) Continuation-in-part of application No. 11/978,892, filed on Oct. 30, 2007, now Pat. No. 8,413,866, which is a continuation-in-part of application No. 11/593,452, filed on Nov. 6, 2006, now abandoned.

(51) Int. Cl.
*A43D 8/14* (2006.01)

(52) U.S. Cl.
USPC ..... 227/67; 227/68; 227/69; 227/73

(58) Field of Classification Search
USPC ..... 227/30, 64, 67, 69, 73, 76, 93, 94, 95, 227/97, 68, 107, 154; 221/30, 74
See application file for complete search history.

(56) References Cited

U.S. PATENT DOCUMENTS

| | | | |
|---|---|---|---|
| 4,039,078 | A | 8/1977 | Bone |
| 4,268,783 | A | 5/1981 | Murray |
| 4,304,227 | A | 12/1981 | Samelson |
| 4,461,738 | A | 7/1984 | Russell |
| 4,484,895 | A | 11/1984 | Smiley et al. |
| 4,511,330 | A | 4/1985 | Smiley et al. |
| 4,714,867 | A | 12/1987 | Palmin et al. |
| 4,790,225 | A | 12/1988 | Moody et al. |
| 4,877,172 | A | 10/1989 | Franklin et al. |
| 4,978,323 | A | 12/1990 | Freedman |
| 5,019,372 | A | 5/1991 | Folkman |
| 5,176,618 | A | 1/1993 | Freedman |
| 5,220,918 | A | 6/1993 | Heide |
| 5,373,859 | A | 12/1994 | Forney |
| 5,433,366 | A | 7/1995 | Deschenes et al. |
| 5,465,734 | A | 11/1995 | Alvarez |
| 5,518,228 | A | 5/1996 | Bodie et al. |

(Continued)

FOREIGN PATENT DOCUMENTS

DE 4307262 9/1994

*Primary Examiner* — Alexandra Elve
*Assistant Examiner* — Nathaniel Chukwurah
(74) *Attorney, Agent, or Firm* — Avery Dennison Corporation

(57) ABSTRACT

A device for dispensing an individual plastic fastener from a supply of fastener stock includes a motor-driven head assembly adapted to receive the supply of fastener stock, sever an individual fastener from the supply and in turn eject the severed fastener. The head assembly includes a pair of needle block assemblies that retain corresponding hollow needles, each needle block assembly being shaped to define a feed channel that transitions a side rail for the fastener stock into axial alignment behind its corresponding needle. In addition, at least one needle block assembly includes a rearward shelf and a forward bowing plate. In use, the lowermost cross-links of the fastener stock fittingly align between the shelf and the bowing plate. In this manner, the lowermost cross-links are limited to distort uniformly upward within the single plane defined by the pair of feed channels, thereby optimizing feed reliability of the device.

22 Claims, 8 Drawing Sheets

(56) References Cited

U.S. PATENT DOCUMENTS

| | | | |
|---|---|---|---|
| 5,598,940 | A | 2/1997 | Finkelstein et al. |
| 5,615,816 | A | 4/1997 | Deschenes et al. |
| 5,649,540 | A | 7/1997 | Alvarez |
| 5,792,067 | A | 8/1998 | Karell |
| 5,809,877 | A | 9/1998 | Szyszko et al. |
| 5,979,456 | A | 11/1999 | Magovern |
| 5,988,171 | A | 11/1999 | Sohn |
| 6,047,823 | A | 4/2000 | Deschenes et al. |
| 6,231,496 | B1 | 5/2001 | Wilk |
| 6,244,865 | B1 | 6/2001 | Nelson |
| 6,250,307 | B1 | 6/2001 | Conrad |
| 6,390,096 | B1 | 5/2002 | Conrad |
| 6,401,717 | B1 | 6/2002 | Conrad |
| 6,408,851 | B1 | 6/2002 | Karell |
| 6,415,796 | B1 | 7/2002 | Conrad |
| 6,450,169 | B1 | 9/2002 | Conrad |
| 6,490,885 | B1 | 12/2002 | Wilkinson |
| 6,523,541 | B2 | 2/2003 | Knudson |
| 6,523,542 | B2 | 2/2003 | Knudson |
| 6,636,767 | B1 | 10/2003 | Knudson |
| 6,742,524 | B2 | 6/2004 | Knudson |
| 6,955,172 | B2 | 10/2005 | Nelson |
| 7,036,680 | B1 * | 5/2006 | Flannery ..... 221/74 |
| 7,073,505 | B2 | 7/2006 | Nelson |
| 7,077,143 | B2 | 7/2006 | Knudson |
| 7,077,144 | B2 | 7/2006 | Knudson |
| 7,188,627 | B2 | 3/2007 | Nelson |
| 2001/0047805 | A1 | 12/2001 | Scarberry |
| 2002/0066702 | A1 | 6/2002 | Liu |
| 2004/0112390 | A1 | 6/2004 | Brooks |
| 2005/0023747 | A1 | 2/2005 | Dunlap et al. |
| 2005/0092332 | A1 | 5/2005 | Conrad |

* cited by examiner

DEVICE FOR DISPENSING PLASTIC FASTENERS

CROSS-REFERENCE TO RELATED APPLICATIONS

The present application is a continuation-in-part of U.S. patent application Ser. No. 11/978,892, filed Oct. 30, 2007, now U.S. Pat. No. 8,413,866, which is in turn a continuation-in-part of U.S. patent application Ser. No. 11/593,452, filed Nov. 6, 2006, now abandoned the disclosures of both applications being incorporated by herein by reference in their entirety.

FIELD OF THE INVENTION

The present invention relates generally to plastic fasteners and more particularly to devices used in the dispensing of plastic fasteners.

BACKGROUND OF THE INVENTION

Plastic fasteners (also commonly referred to in the art as plastic attachments) are well known in the art and commonly used to couple articles of commerce to packaging, buttons to fabric, merchandising tags to articles of commerce, or, in general, any two desired articles. One type of plastic fastener which is widely used in commerce is manufactured in an H-shaped configuration, with two shortened parallel cross-bars, or T-bars, interconnected at their approximate midpoints by a thin, flexible filament that extends orthogonally therebetween.

Plastic fasteners of the type described above are commonly fabricated as part of continuously connected ladder stock that is produced from one or more flexible plastic materials, such as nylon and polypropylene, using conventional molding or stamping techniques. Referring now to FIG. 1, there is shown a length of continuously connected ladder stock 11 that is well known in the art. Ladder, or fastener, stock 11 is formed from two elongated and continuous plastic side members, or rails, 13 and 15 that are interconnected by a plurality of equidistantly spaced cross-links, or filaments, 17. By severing each of side rails 13 and 15 at the approximate midpoint between successive filaments 17, a plurality of individual plastic fasteners 18 can be produced from ladder stock 11. Each plastic fastener 18 produced from ladder stock 11 comprises a pair of cross-bars 19 and 21 that are interconnected by a thin, flexible filament 23, with cross-bars 19 and 21 being derived from side rails 13 and 15, respectively, and filament 23 being derived from a corresponding cross-link 17. Ladder stock of the type described above is shown in U.S. Pat. No. 4,039,078 to A. R. Bone and U.S. Pat. No. 5,615,816 to C. L. Deschenes, the disclosures of both patents being incorporated herein by reference.

Ladder stock of the type described above is presently manufactured and sold by Avery Dennison™ Corporation of Pasadena, Calif. under the Plastic Staple® and Elastic Staple™ lines of plastic fasteners. The commercialized ladder stock is traditionally wound onto a reel, or spool, which is sized and shaped to hold a supply of ladder stock that yields approximately 25,000 fasteners.

Either manually or with the aid of specifically designed devices, individual fasteners are commonly severed from a supply of ladder stock and, in turn, dispensed in order to secure together two or more items. One well known automated device for dispensing individual plastic fasteners from a reel of ladder-type fastener stock includes a pair of hollow needles that are adapted to penetrate through one or more items, a feed mechanism for advancing each rail of the supply of ladder stock into axial alignment behind the longitudinal bore defined by a corresponding hollow needle, a severing mechanism for severing a fastener to be dispensed through the pair of hollowed needles from the remainder of the ladder stock, and an ejection mechanism for ejecting the cross-bars of the severed fastener through the bores of the pair of hollowed needles and, in turn, through the particular items that are penetrated by the needles.

For example, in commonly assigned U.S. Pat. No. 5,433,366, which is incorporated herein by reference, there is disclosed a device for dispensing plastic attachments from a roll of continuously connected ladder stock. In one embodiment, the device includes a pair of hollow slotted needles, each needle having a sharpened tip, a rear end and a longitudinal axis. A feed wheel, placed proximate to the rear ends of the pair of needles, is used to feed the side rails of the ladder stock into the pair of needles through their respective rear ends at angles relative to the longitudinal axes thereof. Once inserted into the needles, an attachment is severed from the remainder of the ladder stock by a knife and is then expelled from the needles by a pair of ejector rods movable along the longitudinal axes of the pair of needles. Because attachments are fed into the pair of needles at angles relative to their longitudinal axes, no shuttling of the needles between an attachment feeding position and an attachment ejection position is required. The pair of needles, the feed wheel, the knife, and the pair of ejector rods are all mounted on a vertically movable head member, or head. An induction motor is used to move the head member between an attachment dispensing position and a withdrawal position. The vertical movement of the head member drives the operation of the feed wheel, the knife and the ejector rods.

As noted briefly above, fasteners of the type as described above are commonly used in a wide variety of different applications to secure together two or more items. For example, fasteners of the type described above are commonly used in packaging applications to secure an article of commerce to a display card. As part of the securement process, the display card is first positioned on an anvil for the fastener dispensing machine. Next, the article of commerce is placed in its desired location on the top surface of the display card. Upon actuation of the machine, the pair of needles penetrates through the display card on opposite sides of the article of commerce and in close proximity relative thereto. As a fastener is severed from the fastener stock and subsequently ejected through the hollow needles, each of the pair of cross-members engages the underside of the card with the thin filament stretching tightly across the front of the article. In this capacity, the dispensed fastener serves to secure the article to the display card in an inconspicuous and unobtrusive manner.

In certain applications, it has been found to be desirable to modify the spacing between the pair of needles for fastener dispensing devices of the type described above. For instance, adjusting the spacing between needles is often required to accommodate supplies of ladder stock with cross-links of varying lengths (e.g., between 0.25 inches and 0.38 inches). In addition, adjusting the spacing between needles is often required to account for variances in the size and shape of articles that are commonly joined using plastic fasteners (e.g., items of different widths that are secured to display cards).

Accordingly, fastener dispensing devices with variable needle spacing are known in the art. Referring now to FIG. 2, there are shown selected components for a prior art device for dispensing individual plastic fasteners from a supply of ladder stock, the fastener dispensing device being identified generally by reference numeral 31. As can be seen, device 31 includes a pair of needles 33-1 and 33-2 that are individually coupled to a motor-driven shuttle 35 by corresponding, mirror image, needle block assemblies 37-1 and 37-2, respectively. As can be appreciated, the lateral position of at least one needle block assembly 37 is adjustable to enable the spacing between needles 33 to be modified as needed. In addition, it should be noted that needle block assemblies 37-1 and 37-2 not only serve to retain needles 33 but also include guide channels 39-1 and 39-2, respectively, that assist in positioning side rails 13 and 15 of ladder stock 11 that are fed into device 31 into proper alignment behind hollow needles 33.

Although well known and widely used in commerce, fastener dispensing devices with variable needle spacing capabilities have been found to suffer from a notable drawback. Specifically, when needles 33 are drawn relatively close to one another, filaments 17 tend to distort (i.e., bow, twist and/or loop) in a random, irregular pattern, as shown in FIG. 2. When a fastener dispensing device with closely spaced needles is used in high speed dispensing applications, the presence of irregularly patterned filament distortions in the ladder stock has been found to significantly increase the likelihood of jamming. Once a jamming condition occurs, the fastener dispensing device needs to be shut down until a relatively labor-intensive and time-consuming repair can occur to remove the jammed ladder stock, which is highly undesirable.

BRIEF SUMMARY OF THE INVENTION

It is an object of the present invention to provide a new and improved device for dispensing a plastic fastener from a supply of fastener stock, the fastener stock being shaped to include an elongated and continuous side rail to which are coupled a plurality of equidistantly spaced filaments.

It is another object of the present invention to provide a device as described above that includes a pair of hollow needles adapted to penetrate through one or more items, a feed mechanism for advancing each rail of the supply of ladder stock into axial alignment behind a corresponding hollow needle, a severing mechanism for severing from the ladder stock a fastener to be dispensed through the pair of needles, and an ejection mechanism for ejecting the cross-bars of the severed fastener through the hollow needles and, in turn, the one or more penetrated items.

It is yet another object of the present invention to provide a device as described above that enables the spacing between the pair of hollow needles to be adjusted.

It is still another object of the present invention to provide a device as described above that reliably feeds the ladder stock into proper alignment behind the pair of hollow needles so as to minimize the likelihood of fastener jamming.

Accordingly, there is provided a device for dispensing an individual plastic fastener from a supply of fastener stock, the fastener stock being shaped to include a pair of continuous side rails to which are coupled a plurality of equidistantly spaced cross-links, the individual fastener comprising a pair of shortened cross-bars that are interconnected by at least one flexible filament, the device comprising (a) a head assembly adapted to receive the supply of fastener stock, sever an individual fastener from the supply of fastener stock and eject the individual fastener during a single stroke of its actuation cycle, and (b) a motor for driving the head assembly through its actuation cycle, (c) wherein the head assembly is adapted to limit distortion of one or more cross-links for the supply of fastener stock fed thereinto within a single plane.

The embodiment of the present invention described below is not intended to be exhaustive or to limit the invention to the precise form disclosed in the following detailed description. Rather, the embodiment is chosen and described so that others skilled in the art may appreciate and understand the principles and practices of the present invention.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

These, as well as other objects and advantages of this invention, will be more completely understood and appreciated by referring to the following more detailed description of the presently preferred exemplary embodiment of the invention in conjunction with the accompanying drawings, of which.

DETAILED DESCRIPTION OF THE INVENTION

The apparatuses and methods disclosed in this document are described in detail by way of examples and with reference to the figures. Unless otherwise specified, like numbers in the figures indicate references to the same, similar, or corresponding elements throughout the figures. It will be appreciated that modifications to disclosed and described examples, arrangements, configurations, components, elements, apparatuses, methods, materials, etc. can be made and may be desired for a specific application. In this disclosure, any identification of specific shapes, materials, techniques, arrangements, etc. are either related to a specific example presented or are merely a general description of such a shape, material, technique, arrangement, etc. Identifications of specific details or examples are not intended to be, and should not be, construed as mandatory or limiting unless specifically designated as such. Selected examples of apparatuses and methods are hereinafter disclosed and described in detail with reference made to FIGURES.

As noted above, traditional fastener dispensing devices with adjustable needle spacing have been found to experience random, multi-directional filament distortion when the pair of needles is drawn closely together. As part of the present invention, applicant has recognized that this irregular pattern of filament distortion in the ladder stock significantly increases the likelihood of fastener jamming within the device. Furthermore, applicant has recognized that by limiting filament distortion upward within a single plane, the array of filaments is formed into a generally uniform, equidistantly spaced pattern that is more reliable (i.e., less likely to become jammed) than traditional fastener dispensing devices.

Figure 1:
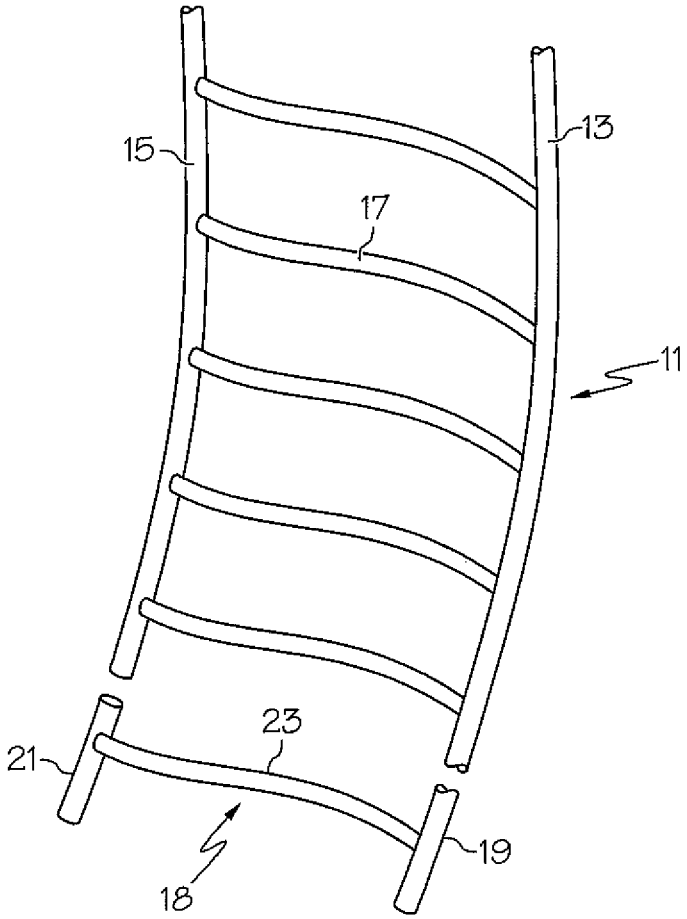
FIG. 1 (PRIOR ART)
FIG. 1 depicts an enlarged, fragmentary, front perspective view of a length of continuously connected fastener stock that is well known in the art.
Figure 2:
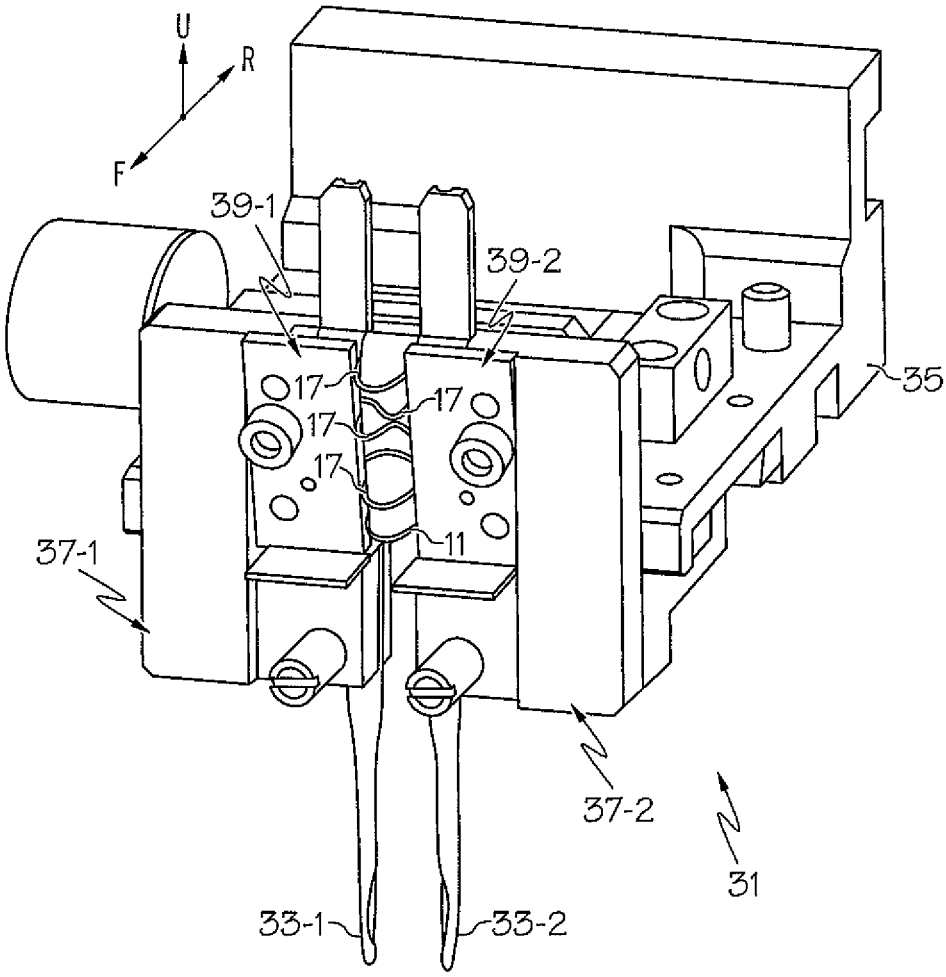
FIG. 2 (PRIOR ART)
FIG. 2 depicts a fragmentary, front perspective view of selected components of a prior art fastener dispensing device, the device being shown with a length of the fastener stock shown in FIG. 1 fed thereinto.
Figure 3:
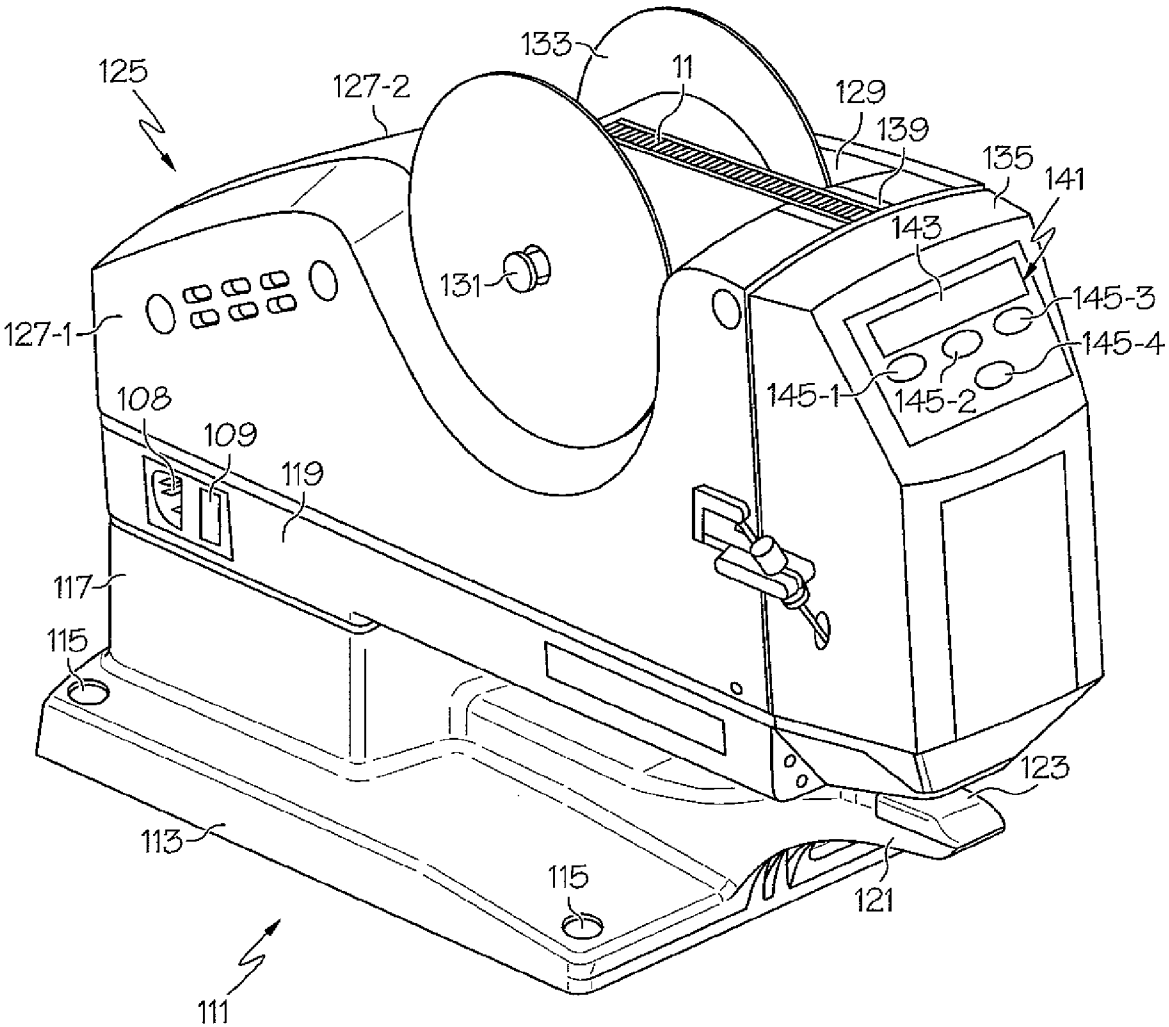
FIG. 3 depicts a top perspective view of a fastener dispensing device constructed according to the teachings of the present invention, the fastener dispensing device being shown with a reel of the fastener stock shown in FIG. 1 mounted thereon and fed thereinto.

Accordingly, referring now to FIG. 3, there is shown a perspective view of a device for dispensing individual plastic fasteners from a supply of continuously connected ladder stock, the device being constructed according to the teachings of the present invention and identified generally by reference numeral 111. As will be described in detail below, device 111 is specifically designed to limit filament distortion in the upward direction (as represented by arrow U in FIG. 3) rather than in the frontward or rearward directions (as represented by arrows F and R, respectively, in FIG. 3) in order to improve operational reliability.

For purposes of simplicity only, device 111 is described herein as being used to dispense individual fasteners 18 from prior art ladder stock 11. However, it should be noted that device 111 not limited to use with any particular type of ladder stock. Rather, it is to be understood that device 111 could be used to dispense individual fasteners from alternate types of dual-rail fastener stock without departing from the spirit of the present invention.

As can be seen, device 111 comprises a substantially rectangular base 113 which serves as the support, or foundation, for device 111. Base 113 may be provided with means to facilitate securing device 111 to a workstation or other similar platform, such as circular transverse bores 115 formed at selected locations along its periphery through which screws can be driven.

A block-shaped neck 117 is integrally formed onto the top surface of base 113. An enlarged, rectangular frame 119 is formed on top of neck 117. As can be appreciated, frame 119 serves as the support, or floor, on which various mechanical and electrical components for device 111 are mounted.

An elongated support arm 121 extends out from both base 113 and neck 117 in an upward and forward manner, support arm 121 being spaced substantially away from the underside of frame 119. A reactor plate 123 is mounted on the free end of support arm 121 and functions, among other things, to support the articles to be coupled by one or more fasteners 18 using device 111.

A protective housing 125 extends upwardly from the free end of frame 119 and includes left and right side casings 127-1 and 127-2 that are secured together by screws. Housing 125 is preferably constructed of a rigid, durable and impact-resistant material, such as plastic, and serves to protect the majority of the electrical and mechanical components for device 111 that are mounted on frame 119.

An arcuate recess 129 is formed in the top surface of housing 125. Furthermore, a cylindrical reel holder 131 is mounted on right side casing 127-2 and extends transversely through recess 129. Holder 131 is sized and shaped to axially pass through a longitudinal bore formed in a reel 133 of ladder stock 11 that is positioned within recess 129. Accordingly, holder 131 serves to support reel 133 in such a manner that reel 133 is capable of freely rotating thereon, thereby affording device 111 with the capability to continuously dispense plastic fasteners 18 in an automated fashion. It should be noted that the majority of reel 133 is retained within recess 129, thereby rendering the combination of reel 133 and device 111 relatively streamlined and compact in nature, which is highly desirable.

A door 135 encloses the front end of housing 125 and is pivotally connected to right side casing 127-2 by hinges to provide access to the head assembly for device 111. A narrow slot 139 is defined between door 135 and housing 125 through which a supply of ladder stock 11 may be fed. Preferably, the dimensions of slot 139 are minimally greater than the lateral cross-section of ladder stock 11 so as to limit the extent by which undesirable contaminants (e.g., dust) can enter into the interior cavity defined by housing 125.

A user interface 141 is provided in the front of pivotally mounted door 135 and preferably includes a digital display panel 143 (e.g., an LCD screen) and one or more control buttons 145-1 thru 145-4. During operation of device 111, user interface 141 provides the operator with means to both monitor relevant historical data relating to usage of device 111 and regulate certain operational characteristics of device 111, which is highly desirable.

Figure 4:
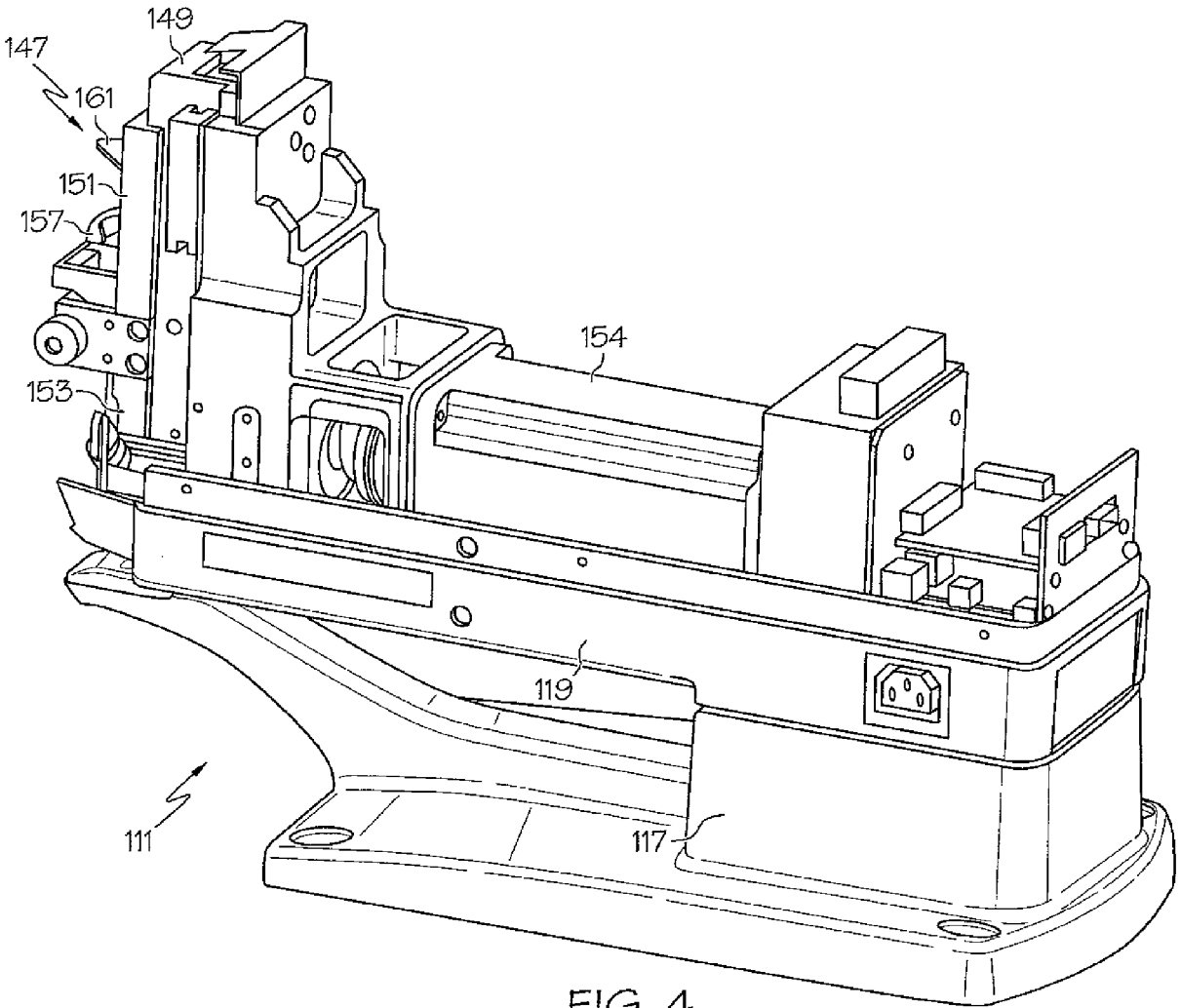
FIG. 4 depicts a rear perspective view of the fastener dispensing device shown in FIG. 3, the fastener dispensing device being shown with its housing and door removed therefrom for purposes of simplicity and clarity.

As seen most clearly in FIG. 4, device 111 includes a head assembly 147 mounted on frame 119 behind door 135 that is responsible for, among other things, feeding the supply of ladder stock 11 into device 111, severing an individual fastener 18 from ladder stock 11 and, in turn, ejecting the severed fastener 18 through the desired articles. It should be noted that head assembly 147 can be easily accessed by the operator by pivoting door 135 open.

Head assembly 147 comprises a vertically extending mount 149 that is fixedly retained in place on frame 119, mount 149 being generally U-shaped in lateral cross-section. In addition, head assembly 147 includes a motor-driven, vertically displaceable head 151 that is slidably coupled to mount 149, the function of head 151 to become apparent below.

Figure 5:
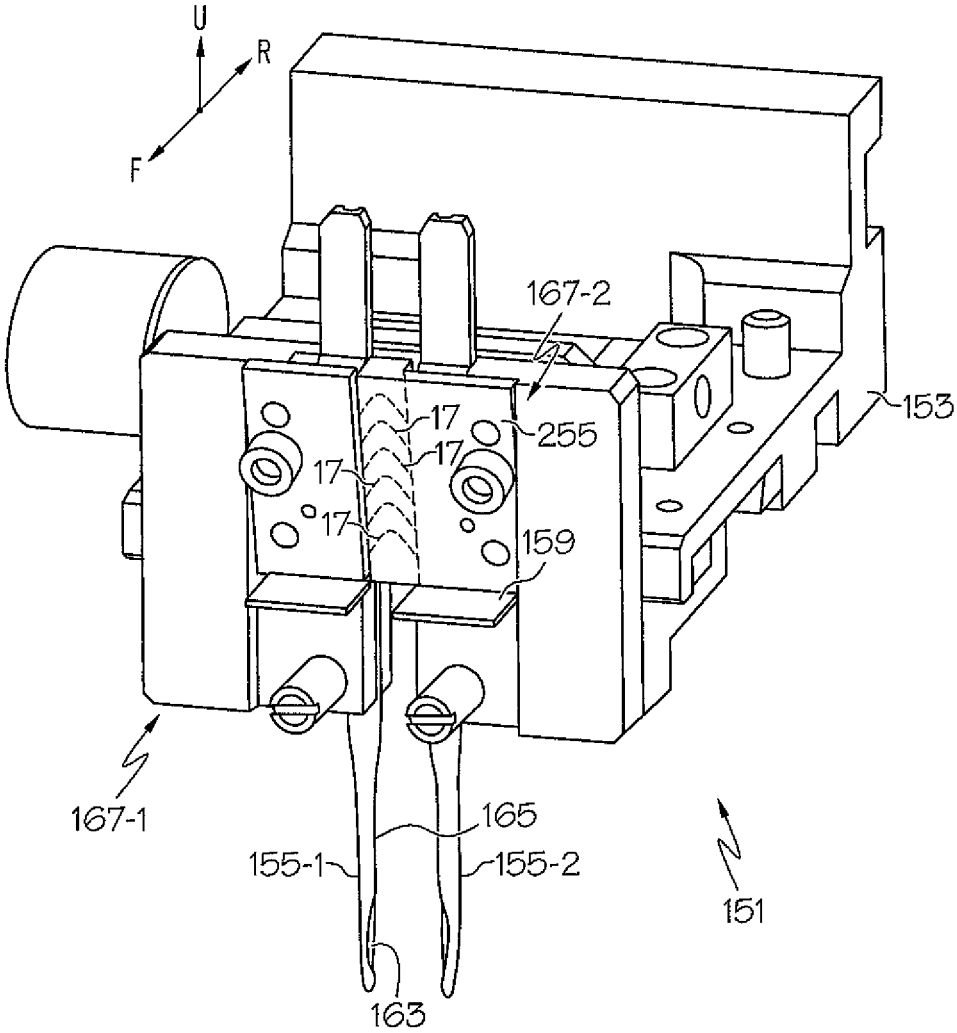
FIG. 5 depicts a fragmentary front perspective view of selected components of the head assembly for the fastener dispensing device and the reel of continuously connected fastener stock shown in FIG. 3, the fastener stock being shown in dashed form.

Referring now to FIGS. 4 and 5, head 151 comprises a shuttle, or base, 153 that is slidably mounted on mount 149 and vertically driven by a motor 154, a pair hollow needles 155-1 and 155-2 that are coupled to vertically displaceable shuttle 153, a feed mechanism 157 for advancing the side rails 13 and 15 of ladder stock 11 into axial alignment behind the longitudinal bores defined by needles 155, a severing mechanism 159 for cutting side members 13 and 15 of ladder stock 11 at the approximate midpoint between successive cross-links 17 to separate an individual plastic fastener 18 from the remainder of ladder stock 11, and an ejection mechanism 161 for ejecting cross-bars 19 and 21 of a severed plastic fastener 18 through needles 155-1 and 155-2 and in turn through one or more of the items to be joined together by fastener 18.

Each needle 155 is conventional in construction and includes an elongated longitudinal bore 163 and a narrow longitudinal slot 165 in communication with bore 163. As noted above, needles 155 are coupled to motor-driven shuttle 153. Accordingly, it is to be understood that the downward displacement of shuttle 153 in turn causes needles 155 to similarly travel downward so as to penetrate through any articles supported on reactor plate 123 that are to be coupled together by plastic fasteners 18.

Needles 155-1 and 155-2 are coupled to motor-driven shuttle 153 by corresponding needle block assemblies 167-1 and 167-2, respectively. As can be appreciated, needle block assemblies 167 are responsible for both retaining needles 155 and assisting in the guidance of side rails 13 and 15 of ladder stock 11 that is fed into device 31 into position behind hollow needles 155-1 and 155-2, respectively. As a principal feature of the present invention, needle block assemblies 167 are additionally designed to apply pressure onto the lowermost cross-links 17 of fastener stock 11 that is fed into device 111 so as to limit filament distortion within a single plane (i.e., upward in the plane defined by arrow U in FIG. 5), as will be described in detail below below.

Figure 6:
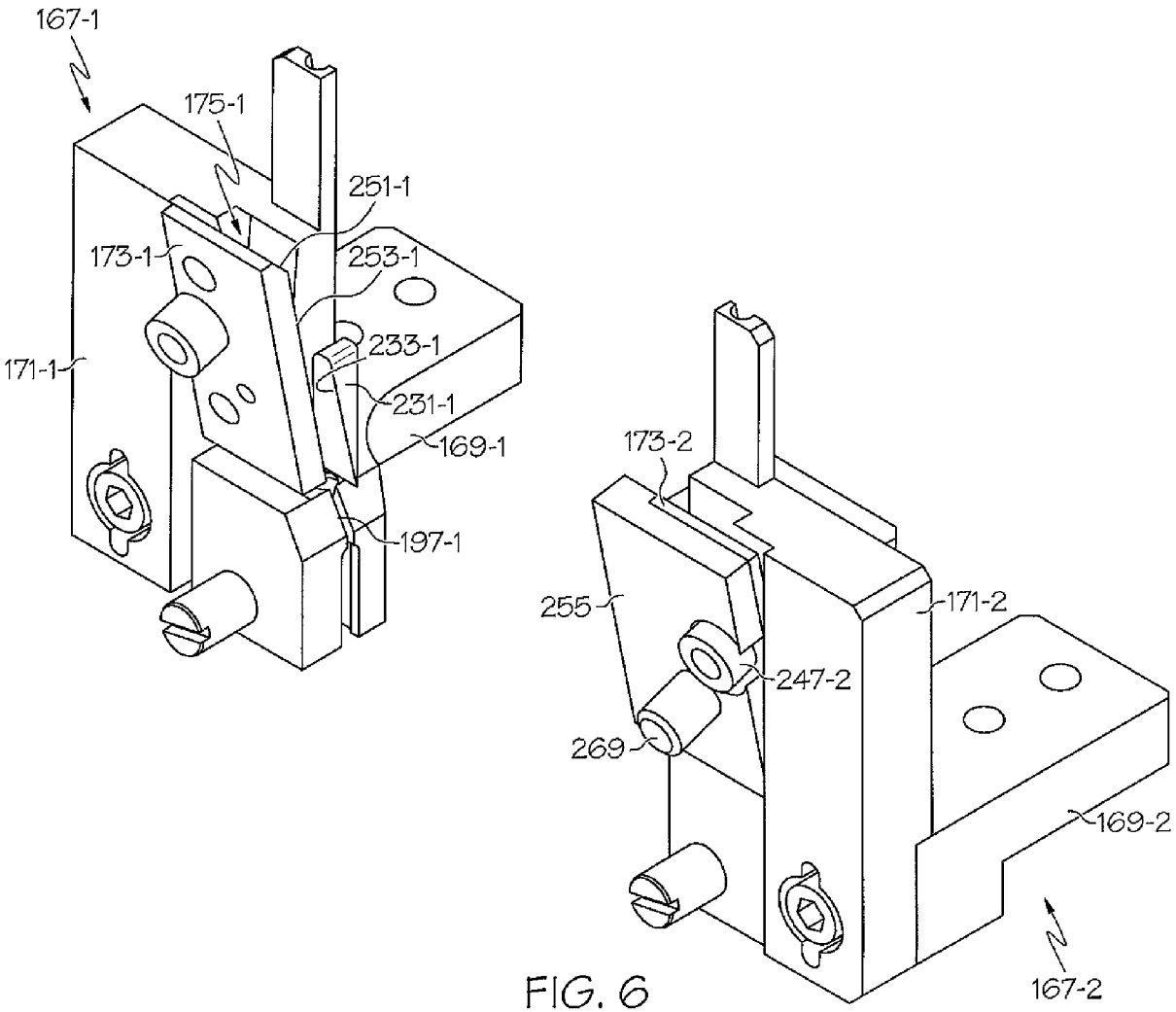
FIG. 6 depicts a front perspective view of the pair of needle block assemblies shown in FIG. 5.
Figure 7:
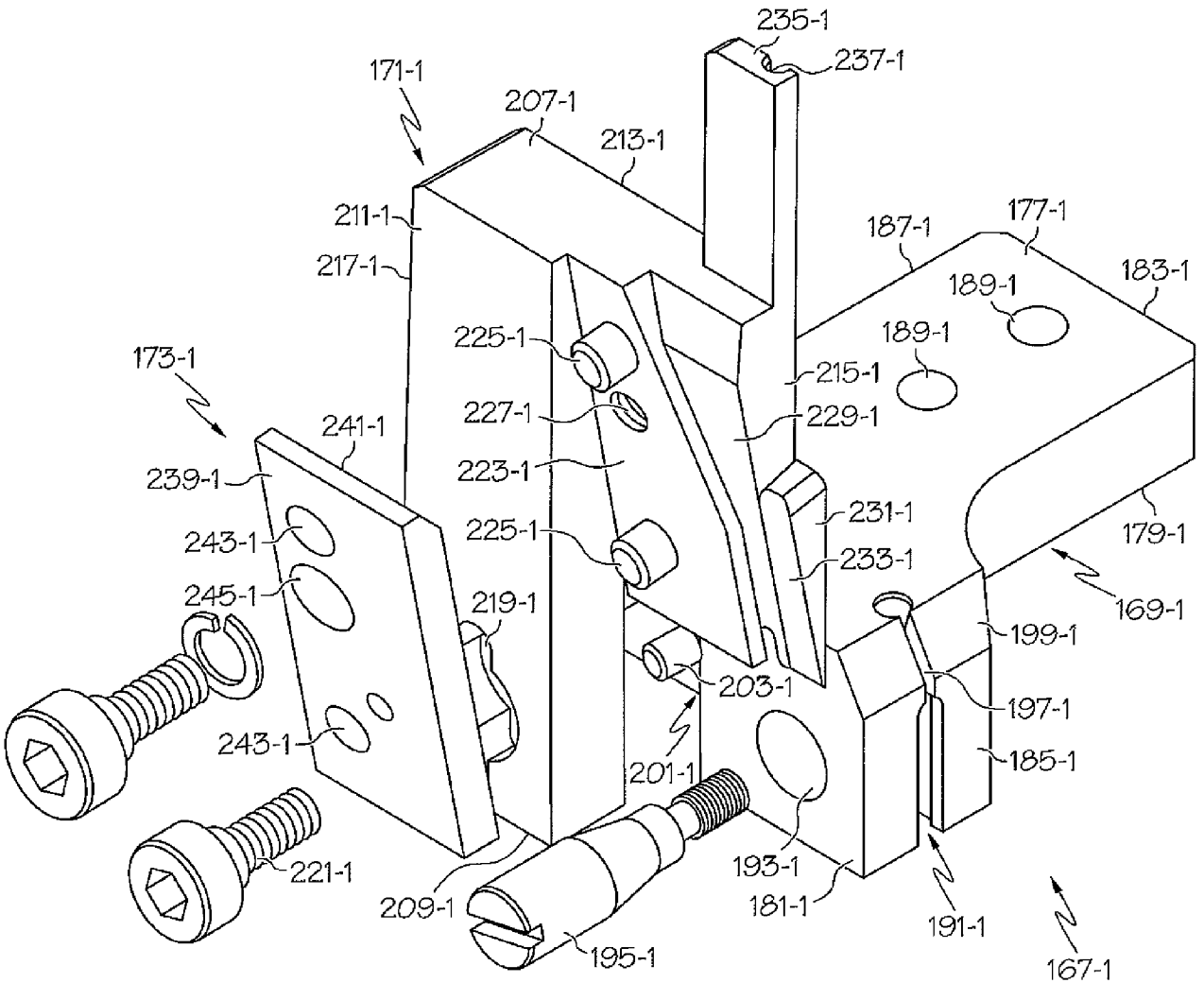
FIG. 7 depicts an exploded front perspective view of the left side needle block assembly shown in FIG. 6.

Specifically, as seen most clearly in FIGS. 6 and 7, left side needle block assembly 167-1 comprises a needle block 169-1 that is fixedly mounted onto the underside of shuttle 153, a guide block 171-1 mounted on the front of needle block 169-1 and a cover plate 173-1 mounted on the front of guide block 171-1. Together, needle block 169-1, guide block 171-1 and cover plate 173-1 define a substantially enclosed feed channel 175-1 that is designed to transition side rail 15 into axial alignment behind needle 155-1.

Needle block 169-1 is a unitary, generally L-shaped support member that includes a substantially flat top surface 177-1, a substantially flat bottom surface 179-1, a front end surface 181-1, a rear end surface 183-1, an inner side surface 185-1 an outer side surface 187-1. A pair of vertically oriented bores 189-1 is formed in needle block 169-1 along rear end surface 183-1. Although not shown herein, a pair of corresponding screws is disposed through bores 189 and into threaded engagement with holes in the underside of shuttle 153 to secure needle block 169-1 onto shuttle 153.

Needle block 169-1 is also shaped to define a partially protruding, vertical needle bore 191-1 in its bottom surface 179-1 along inner surface 185-1, bore 191-1 being dimensioned to fittingly receive the base, or stem, of needle 155-1. A transverse hole 193-1 is formed in front end surface 181-1 that extends into communication with needle bore 191-1. As such, a retention screw 195-1 can be axially driven through bore 191-1 and into frictional engagement with needle 155-1 mounted therein, thereby fixedly securing needle 155-1 in place within needle block 169-1. Similarly, withdrawal of retention screw 195-1 from bore 191-1 thereby allows for the removal of needle 155-1 from needle block 169-1 (e.g., for replacement, repairs, etc.).

A lower feed channel 197-1 is formed in top surface 177-1 of needle block 169-1 in coaxial alignment with needle bore 191-1. As a result, side rail 15 of ladder stock 11 can be axially advanced through lower feed channel 197-1 and into alignment behind needle 155-1, as will be described further below. A chamfered face 199-1 is formed at the junction of top and inner side surfaces 177-1 and 185-1, face 199-1 extending at an approximate 30 degree angle relative to the vertical axis to facilitate entry of side rail 15 from lower feed channel 197-1 into hollow needle 155-1.

Front end surface 181-1 is shaped to include a recess 201-1 along outer side surface 187-1, recess 201-1 being dimensioned to receive a portion of guide block 171-1. A pair of spaced apart posts 203-1 is formed along front end surface 181-1 and project into recess 201-1. In addition, a threaded hole (not shown) is formed into front end surface 181-1 between posts 203-1, the function of posts 203-1 and the threaded hole to become apparent below.

Guide block 171-1 is a unitary member that includes a substantially flat top surface 207-1, a substantially flat bottom surface 209-1, a front end surface 211-1, a rear end surface 213-1, an inner side surface 215-1 an outer side surface 217-1. A pair of bores (not shown) extends into rear end surface 213-1 and are aligned and dimensioned to fittingly receive posts 203-1 when guide block 171-1 is mounted on needle block 169-1. In addition, a transverse bore 219-1 extends through guide block that aligns with the threaded hole in needle block 169-1 when guide block 171-1 is mounted on needle block 169-1. In this manner, a threaded screw 221-1 can be inserted through bore 219-1 and into engagement with the threaded hole in needle block 169-1 to retain guide block 171-1 in place on needle block 169-1.

Front end surface 211-1 of guide block 171-1 is recessed along inner side surface 215-1 so as to define an angled front wall 223-1. A pair of spaced apart pins 225-1 extends out from angled front wall 223-1. In addition, a threaded hole 227-1 is formed into angled front wall 223-1 between pins 225-1. As will be described further below, pins 225-1 and hole 227-1 assist in securing cover plate 173-1 to guide block 171-1.

A funnel-shaped cutout 229-1 is formed into angled front wall 223-1 along inner side surface 215-1, the inclusion of cutout 229-1 to become apparent below. As can be seen, cutout 229-1 tapers gradually inward from top surface 207-1 to bottom surface 209-1 so as to axially align with the entrance for lower feed channel 197-1.

A wedged-shaped projection, or shelf, 231-1 extends out from inner side surface 215-1 along its bottom edge. Shelf 231-1 includes a flat front contact surface 233-1 that is generally flush (i.e. coplanar) with cutout 229-1. As will be described further below, shelf 231-1 is provided to prevent rearward distortion of the lowermost filaments 17 in ladder stock 11 that is fed into device 111.

An upwardly protruding ejector rod support block 235-1 is formed onto top surface 207-1 along rear end surface 213-1. The rear surface of support block 235-1 is shaped to define a vertically extending, longitudinal channel 237-1 that is generally semi-circular in cross-section. In use, an ejector rod for ejection mechanism 161 is designed to displace vertically downward within channel 237-1 and push cross-bar 21 of severed fastener 18 out through the open tip of needle 155-1.

Cover plate 173-1 is generally in the form of a rectangular plate that includes a flat front surface 239-1 and a flat rear surface 241-1. Cover plate 173-1 is shaped to define a pair of transverse bores 243-1 that are arranged and dimensioned to fittingly receive pins 225-1 on guide block 171-1. In addition, a central bore 245-1 is formed into cover plate 173-1 between bores 243-1. Accordingly, with cover plate 173-1 mounted on guide block 171-1, a hex screw 247-1 (with a washer 249-1 axially mounted thereon) can be inserted through central bore 245-1 and into threaded engagement with threaded hole 227-1 to retain cover plate 173-1 onto guide block 171-1.

With cover plate 173-1 mounted onto guide block 171-1, a funnel-shaped upper feed channel 251-1 is defined therebetween that terminates in direct axial alignment with the entry for lower feed channel 197-1. In this capacity, upper feed channel 251-1 and lower feed channel 197-1 together define the continuous feed channel 175-1 for needle block assembly 167-1, with the flat front contact surface 233-1 of shelf 231-1 extending immediately inside and behind the continuous filament slot 253-1 for feed channel 175-1, as seen most clearly in FIG. 6.

Figure 8:
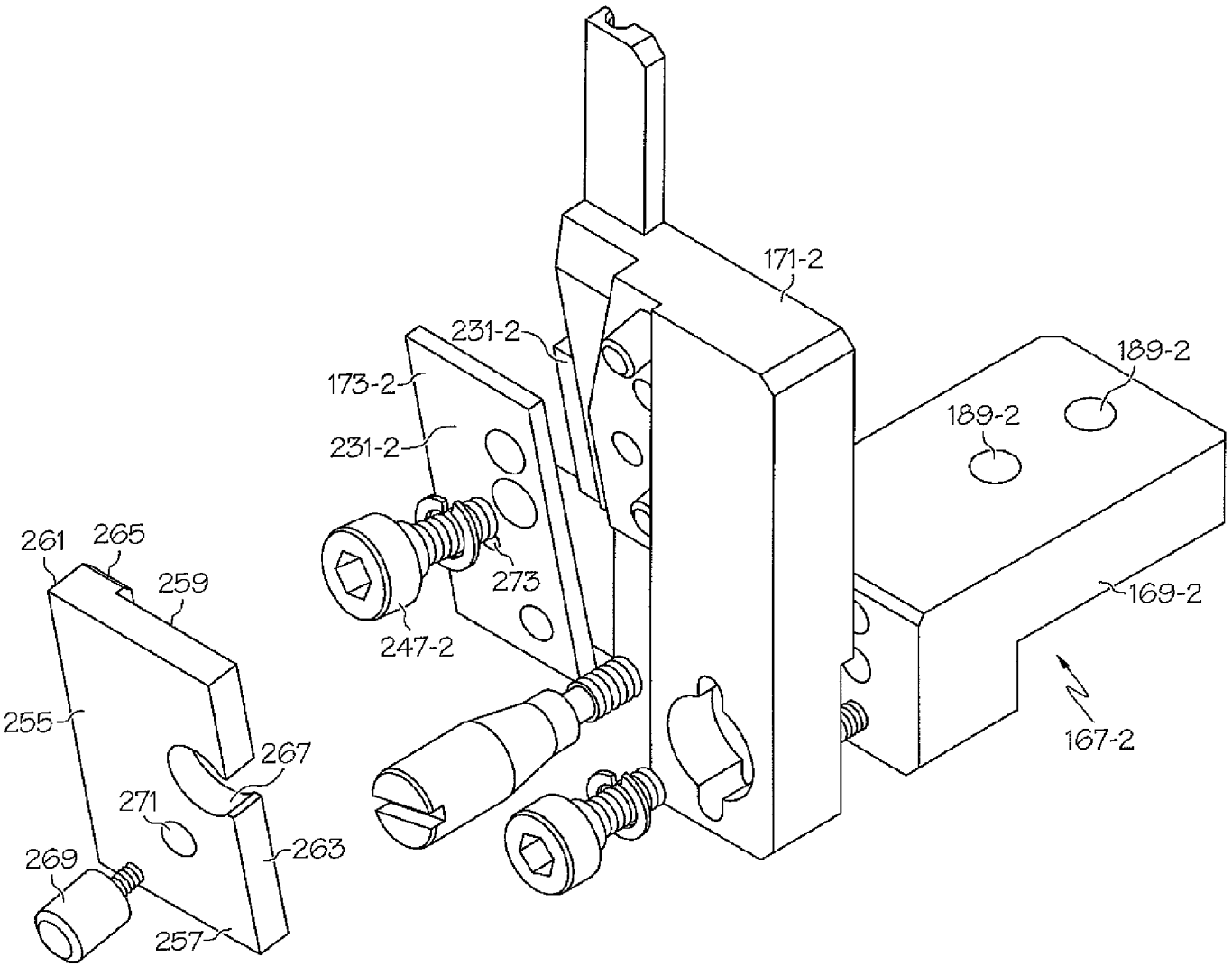
FIG. 8 depicts an exploded front perspective view of the right side needle block assembly shown in FIG. 6.

Referring now to FIGS. 6 and 8, right needle block assembly 167-2 is similar in construction to left needle block assembly 167-1 in that right needle block assembly 167-2 includes a needle block 169-2 fixedly mounted onto the underside of shuttle 153, a guide block 171-2 mounted on the front of needle block 169-2 and a cover plate 173-2 mounted on the front of guide block 171-2, with each of needle block 169-2, guide block 171-2 and cover plate 173-2 being a rough mirror image of needle block 169-1, guide block 171-1 and cover plate 173-1, respectively. Accordingly, it is to be understood that shelf 231-2 on guide block 171-2 similarly applies continuous pressure against the rear of the lowermost cross-links 17 of fastener stock 11 fed into device 111 so as to prevent rearward distortion, which is highly desirable.

It should be noted that right needle block 169-2 is designed to be laterally displaced relative to left needle block 169-1 and, in turn, secured to shuttle 153 by passing threaded screws through vertical bores 189-2. As a result, it is to be understood that the spacing between needles 155-1 and 155-2 can be adjusted, preferably between 6.5 mm and 12.5 mm, to increase the range of potential applications for device 111. In addition, it should be noted that as needle blocks 169 are drawn closer to one another, fastener stock 11 loaded into device 111 is rendered more susceptible to filament 17 distortion.

Right needle block assembly 167-2 differs principally in design from left needle block assembly 167-1 in that right needle block assembly 167-2 additionally includes a bowing plate 255 that is mounted over front surface 239-2 of cover plate 173-2. As seen most clearly in FIG. 8, cover plate 173-2 is slightly less in thickness than cover plate 173-1 to accommodate for the thickness of bowing plate 255 (i.e., the combined thickness of cover plate 173-2 and bowing plate 255 being roughly equal to the thickness of cover plate 173-1).

Bowing plate 255 is a generally rectangular plate that is generally L-shaped in transverse cross-section, bowing plate 255 including a flat front surface 257, a flat rear surface 259, an inner side surface 261 and an outer side surface 263. As can be seen, a rearwardly extending projection, or flange, 265 is formed on rear surface 259 along inner side surface 261, the function of flange 265 to become apparent below.

Bowing plate 255 is shaped to define an enlarged, scalloped cutout 267 along outer side surface 263, cutout 267 being dimensioned and aligned to receive hex screw 247-2 when bowing plate 255 is mounted over cover plate 173-2. A knurled grip screw 269 is designed for insertion through a bore 271 in bowing plate 255 and into threaded engagement within a hole 273 in cover plate 173-2 to secure bowing plate 255 in place on cover plate 173-2.

With bowing plate 255 secured to cover plate 173-2 in the manner set forth above, it is to be understood that flange 265 extends rearwardly in the direction towards shelf 231-2 and is dimensioned so as to apply continuous pressure against the front of the lowermost filaments 17 of ladder stock 11 fed into device 111. As a result, the lowermost filaments 17 are effectively sandwiched between shelves 231-2 and flange 265.

Accordingly, as a primary feature of the present invention, it is to be understood that needle block assemblies 167 limit filament distortion of ladder stock 11 fed into device 111 in the upward direction along a single plane with generally uniform spacing achieved between adjacent cross-links 17. Specifically, as seen most clearly in FIG. 5, left and right shelves 231 together apply continuous pressure against the back of the lowermost cross-links 17 of ladder stock 11 fed into device 111, thereby limiting any rearward distortion (i.e., in the direction of arrow R). At the same time, flange 265 of bowing plate 225 applies continuous pressure against the front of the lowermost cross-links 17 of ladder stock fed 11 fed into device 111, thereby limiting any frontward distortion (i.e., in the direction of arrow F). Consequently, the forces applied to cross-links 17 due to the close spacing of needles 155 results in filament distortion upward within the single common plane defined by the pair of feed channels 175 (i.e., in the plane defined by arrow U). By eliminating forward and rearward filament distortion, device 111 is designed to optimize the orientation of filaments 17 for fastener stock 11 fed thereinto and is thereby less likely to experience fastener jamming, which is highly desirable.

For simplicity purposes and ease of illustration, additional details relating to the construction and operation of feed mechanism 157, severing mechanism 159 and ejection mechanism 161 for head 151 are not shown in detail herein. Rather, the details relating to the aforementioned mechanisms may be found, for example, in presently-pending U.S. patent application Ser. No. 11/978,892, filed Oct. 30, 2007, of which this application is a continuation-in-part.

It will thus be seen according to the present invention a highly advantageous fastener dispensing machine has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

What is claimed is:

1. A device for dispensing an individual plastic fastener from a supply of fastener stock, the supply of fastener stock being shaped to include a pair of continuous side rails to which are coupled a plurality of equidistantly spaced cross-links, the individual fastener comprising a pair of shortened cross-bars that are interconnected by at least one flexible filament, the device comprising:

(a) a head assembly adapted to receive the supply of fastener stock, sever an individual fastener from the supply of fastener stock and eject the individual fastener during a single stroke of its actuation cycle wherein the head assembly includes a pair of hollowed needles, each needle being retained by a corresponding needle block assembly each needle being shaped to define a longitudinal bore and wherein the needle block assembly includes a bowing plate coupled to the cover plate, the bowing plate being adapted to prevent forward distortion of the one or more cross-links, and (b) a motor for driving the head assembly through its actuation cycle, (c) wherein the head assembly is adapted to limit distortion of one or more cross-links for the supply of fastener stock fed thereinto within a single plane.

2. The device as claimed in claim 1 wherein the head assembly comprises, (a) a head, the head comprising a pair needle block assemblies that are fixedly mounted on a shuttle, the shuttle being slidably coupled to a fixed mount, (c) a feed mechanism for advancing each side rail of the supply of fastener stock into direct axial alignment behind the longitudinal bore of a corresponding hollowed needle, (d) a severing mechanism for separating an individual fastener from the supply of fastener stock, and (e) an ejection mechanism for ejecting each cross-bar of the individual fastener axially through the longitudinal bore of a corresponding hollowed needle.

3. The device as claimed in claim 2 wherein each needle block assembly includes a feed channel that is adapted to receive one side rail of the supply of fastener stock, the feed channel transitioning the side rail into axial alignment behind the longitudinal bore of its corresponding hollowed needle.

4. The device as claimed in claim 3 wherein the pair of feed channels is coplanar.

5. The device as claimed in claim 4 wherein at least one of the pair of needle block assemblies is adapted to limit distortion of the one or more cross-links to the single plane defined by the pair of feed channels.

6. The device as claimed in claim 5 wherein at least one of the pair of needle block assemblies is adapted to continuously apply pressure onto the one or more cross-links to prevent forward and rearward distortion thereof.

7. The device as claimed in claim 6 wherein at least one of the pair of needle block assemblies comprises, (a) a needle block fixedly mounted onto the shuttle, the needle block being shaped to include a bore for receiving one of the pair of hollow needles, (b) a guide block mounted on the needle block, the guide block being shaped to define a cutout in communication with the bore in the needle block, and (c) a cover plate mounted on the guide block for substantially enclosing the cutout, the cutout defining at least a portion of the guide channel for the needle block assembly.

8. The device as claimed in claim 7 wherein at least one of the needle blocks is adapted to be displaced relative to the other of the needle blocks in order to adjust the spacing between the pair of hollowed needles.

9. The device as claimed in claim 8 wherein the guide block includes a shelf positioned outside the guide channel for the needle block assembly, the shelf comprising a flat front contact surface that is generally flush with the cutout.

10. The device as claimed in claim 9 wherein the shelf is adapted to prevent rearward distortion of the one or more cross-links.

11. The device as claimed in claim 1 wherein the bowing plate includes a front surface, a rear surface and a projection extending out from the rear surface.

12. The combination of:

(a) a supply of fastener stock from which can be dispensed an individual plastic fastener, the supply of fastener stock being shaped to include a pair of continuous side rails to which are coupled a plurality of equidistantly spaced cross-links, the individual fastener comprising a pair of shortened cross-bars that are interconnected by at least one flexible filament, and (b) a device for dispensing an individual plastic fastener from the supply of fastener stock, the device comprising:

(i) a head assembly adapted to receive the supply of fastener stock, sever an individual fastener from the supply of fastener stock and eject the individual fastener during a single stroke of its actuation cycle wherein the head assembly comprises a pair of hollowed needles, each needle being retained by a corresponding needle block assembly, each needle being shaped to define a longitudinal bore and a guide block mounted on the needle block, the guide block being shaped to define a cutout in communication with the bore in the needle block wherein the guide block includes a shelf positioned outside the guide channel for the needle block assembly, the shelf comprising a flat front contact surface that is generally flush with the cutout, and (ii) a motor for driving the head assembly through its actuation cycle, (iii) wherein the head assembly is adapted to limit distortion of one or more cross-links for the fastener stock fed thereinto within a single plane.

13. The combination of claim 12 wherein the head assembly comprises, (a) a head, the head comprising a pair needle block assemblies that are fixedly mounted on a shuttle, the shuttle being slidably coupled to a fixed mount, (b)

(c) a feed mechanism for advancing each side rail of the supply of fastener stock into direct axial alignment behind the longitudinal bore of a corresponding hollowed needle, (d) a severing mechanism for separating an individual fastener from the supply of ladder stock, and (e) an ejection mechanism for ejecting each cross-bar of the individual fastener axially through the longitudinal bore of a corresponding hollowed needle.

14. The combination as claimed in claim 13 wherein each needle block assembly includes a feed channel that is adapted to receive one side rail of the supply of fastener stock, the feed channel transitioning the side rail into axial alignment behind the longitudinal bore of its corresponding hollowed needle.

15. The combination as claimed in claim 14 wherein the pair of feed channels is coplanar.

16. The combination as claimed in claim 15 wherein at least one of the pair of needle block assemblies is adapted to limit distortion of the one or more cross-links to the single plane defined by the pair of feed channels.

17. The combination as claimed in claim 16 wherein at least one of the pair of needle block assemblies is adapted to continuously apply pressure onto the one or more cross-links to prevent forward and rearward distortion thereof.

18. The combination as claimed in claim 17 wherein at least one of the pair of needle block assemblies comprises, (a) a needle block fixedly mounted onto the shuttle, the needle block being shaped to include a bore for receiving one of the pair of hollow needles, (c) a cover plate mounted on the guide block for substantially enclosing the cutout, the cutout defining at least a portion of the guide channel for the needle block assembly.

19. The combination as claimed in claim 18 wherein at least one of the needle blocks is adapted to be displaced relative to the other of the needle blocks in order to adjust the spacing between the pair of hollowed needles.

20. The combination as claimed in claim 19 wherein the at least one needle block assembly additionally includes a bowing plate coupled to the cover plate, the bowing plate being adapted to prevent forward distortion of the one or more cross-links.

21. The combination as claimed in claim 20 wherein the bowing plate includes a front surface, a rear surface and a projection extending out from the rear surface.

22. The combination as claimed in claim 12 wherein the shelf is adapted to prevent rearward distortion of the one or more cross-links.

* * * * *